United States Patent [19]

Bretz, Jr.

[11] 3,933,225

[45] Jan. 20, 1976

[54] SHOCK ABSORBING MEANS FOR RAILWAY HAND BRAKE MECHANISM

[75] Inventor: Frank E. Bretz, Jr., Elmhurst, Ill.

[73] Assignee: Cleveland Hardware and Forging Company, Cleveland, Ohio

[22] Filed: June 10, 1974

[21] Appl. No.: 477,898

[52] U.S. Cl. ..... 188/33; 74/505; 254/149

[51] Int. Cl.[2] ..... B61H 1/00

[58] Field of Search ..... 74/505; 188/33; 267/140, 267/141; 254/169, 149, 135 R, 156, 167, 190 R, 197, 191; 192/16

[56] References Cited

UNITED STATES PATENTS

| | | | |
|---|---|---|---|
| 970,848 | 9/1910 | Pathonaggio | 267/140 |
| 2,733,790 | 2/1956 | Dyke | 74/505 |
| 3,040,597 | 6/1962 | Bretz, Jr. | 188/33 |
| 3,684,272 | 8/1972 | Ticknor | 267/140 |
| 3,785,679 | 1/1974 | Peterson et al. | 267/140 |

*Primary Examiner*—Robert J. Spar
*Assistant Examiner*—Kenneth Noland
*Attorney, Agent, or Firm*—Lockwood, Dewey, Zickert & Alex

[57] ABSTRACT

Kinetic energy shock incident to the trip release of the chain under tension of a railway car hand brake mechanism is absorbed by one or more blocks of compressible shock-absorbing solid material or by compressible shock-absorbing spring means located within the housing of the mechanism and in the path of the chain when the brake is tripped or released and the chain is prevented from winding in the wrong direction and consequently damaging the hand brake mechanism at one end of the chain and brake components at the other end of the chain.

9 Claims, 5 Drawing Figures

12
15
20
60
61
62
63
64
65
66
68
69
70
71
72
73
13
59
4

SHOCK ABSORBING MEANS FOR RAILWAY HAND BRAKE MECHANISM

This invention relates generally to hand brake mechanisms for railway cars and it constitutes an improvement in hand brake constructions of the type disclosed in Bretz, Jr., U.S. Pat. No. 3,040,597, issued June 26, 1972 and Koehler, U.S. Pat. No. 3,714,842, issued Feb. 6, 1973.

The above patents disclose a hand brake mechanism for railway cars in which a chain connected to the brake rigging is wound on a chain winding drum or capstan under tension to apply the brakes. Provision is made for quickly releasing the tension in the chain to release the brakes. This release is accompanied by a rapid reverse rotation of the drum. A portion of the chain strikes a rigid chain stop mounted on the wall of the housing for the brake mechanism and thereby is prevented from winding in a reverse direction on the drum. The incremental damage to the links of the chain which repetitively stroke the chain stop is cumulative as the brake is repeatedly released and eventually necessitates chain replacement. Other parts of the brake mechanism are also subject to damage as a result of such actions.

Among the objects of this invention are: to provide for absorbing the energy incident to the release of a hand brake mechanism in a new and improved manner; to employ for this purpose resilient shock-absorbing means located in the path of the links of the chain adjacent the drum from which the chain is unwound; and to fashion the resilient means from one or more blocks of compressible solid material or from spring means.

Figure 1:
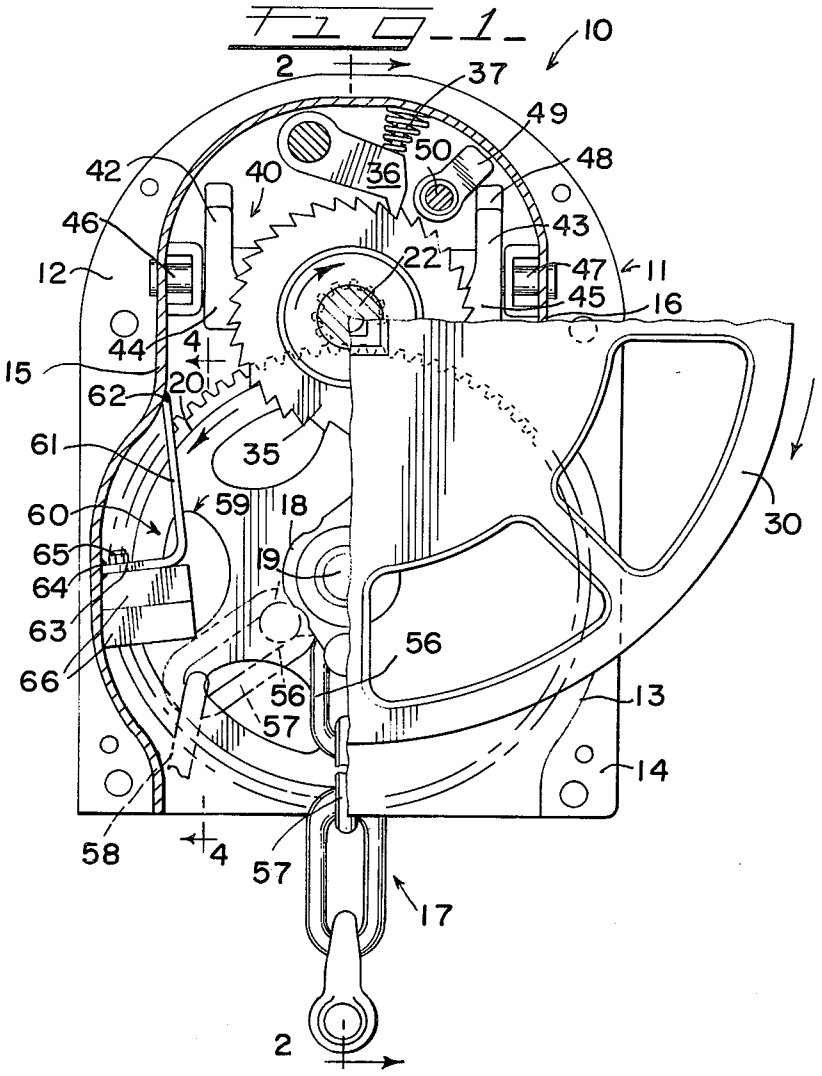
FIG. 1 is a view, in front elevation, of a hand brake mechanism in which this invention is embodied, portions being broken away to show more clearly the internal details of construction.
Figure 2:
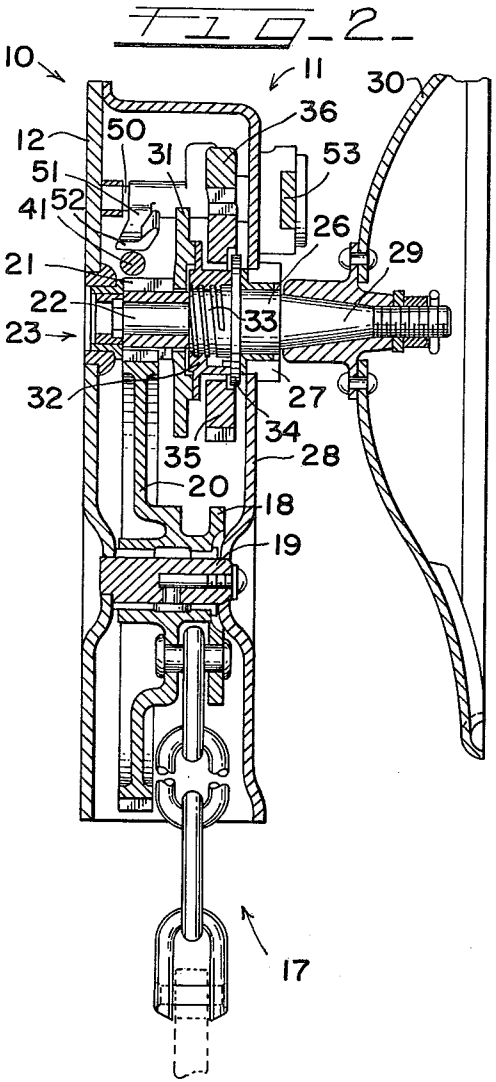
FIG. 2 is a vertical sectional view taken generally along line 2—2 of FIG. 1.

In FIGS. 1 and 2 the reference character 10 designates, generally, a hand brake mechanism of the kind and character disclosed in the above patents but modified in accordance with this invention. The hand brake mechanism 10 includes a metallic case or housing 11, which is made up of a back plate 12 and a cover 13 which is provided with an outstanding flange 14 overlying the outer edge portions of the back plate 12 and cover 13 and suitably secured thereto for suitable mounting on a railroad car. The cover 13 is provided with side walls 15 and 16.

For applying and releasing the brakes there is provided a chain, shown generally at 17, that is connected in known manner to the brake rigging such as by pin 53. For applying the brakes the chain 17 is wound on a chain winding drum 18 that is journaled on a shaft 19. A main gear wheel 20 suitable connected to or integral with drum 18 is arranged to be driven by a pinion 21 which is freely rotatably mounted on a reduced diameter section 22 of a hand wheel shaft that is indicated, generally, at 23. At its rear the hand wheel shaft 23 is suitably journaled on the back plate 12. It has a bearing portion 26 near its front end which is journaled in a bushing 27 that is mounted on the front wall 28 of the cover 13. At the outer end of the hand wheel shaft 23 there is a hand wheel receiving section 29 on which a hand wheel 30 is non-rotatably mounted.

In order to provide a driving connection between the hand wheel 30 and the pinion 21, the latter has slidably mounted thereon a radially extending flange 31. As described in the patents above referred to, provision is made for mechanically interconnecting the radially extending flange 31 and a pressure nut 32 which is mounted on a threaded section 33 of the hand wheel shaft 23. A brake flange 34 is integral with the hand wheel shaft 23 and located between it and the pressure nut 32 is a ratchet wheel 35. The ratchet wheel 35 is prevented from reverse rotation by a pawl 36.

For applying the brakes, the hand wheel 30 is rotated in a clockwise direction as viewed in FIG. 1 thereby rotating ratchet wheel 35 in a clockwise direction and the main gear wheel 20 and chain drum 18 in a counterclockwise direction, as indicated by the arrows thereon. Since some tension is applied to the chain 17 there will be some resistance to rotation by the pinion 21 and the pressure nut 32. The rotation of the hand wheel 30 and hand wheel shaft 23 against this tension causes the pressure nut 32 to rotate slightly along the threaded section 33. As a result, the ratchet wheel 35 is clamped between the pressure nut 32 and the brake flange 34. As long as the flange 31 maintains it mechanical connection to the pressure nut 32, the driving connection to the pinion 21 is maintained. Reverse rotation is prevented by the pawl 36.

It may be desirable to quickly release the brakes by shifting the radially extending flange 31 out of mechanical engagement with the pressure nut 32 for interrupting the driving connection between the hand wheel shaft 23 and the pinion 21. This is accomplished through the provision of trip bar means indicated, generally at 40. The trip bar means 40 comprises a tie bar 41 to the ends of which levers 42 and 43 are secured. Jaws 44 and 45 at distal ends of the levers 42 and 43 are arranged, as described in the above patents, to engage opposite sides of the radially extending flange 31 for shifting it into and out of engagement with the pressure nut 32 for controlling the driving engagement between the hand wheel shaft 23 and the pinion 21. Coil compression springs, not shown, interposed in known manner between the back plate 12 and the jaws 44 and 45 are effective to bias the radially extending flange 31 into driving engagement with the pressure nut 32.

The ends of the trip bar means 40 are suitably journaled at 46 and 47 on the side walls 15 and 16. The pivotal mounting may be as disclosed in the above Koehler patent, or other known designs.

For manually shifting the trip bar means 40 to displace the radially extending flange 31 from driving engagement with the pressure nut 32, the lever 43 is provided with a lever arm 48 that is arranged to be engaged by a cam arm 49 that extends radially from a cam shaft 50. The rear end of the cam shaft 50 is journaled on the back plate 12 and the front end is journaled on the front wall 28. A safety arm 51 extends radially from the cam shaft 50 and is provided with a flared end 52 for preventing inadvertent disengagement of the radially extending flange 31 from driving engagement with the pressure nut 32.

The forward end of the cam shaft 50 extends through the front wall 28 of the cover 13 where a manually operable trip lever 53 is mounted thereon. As shown, the trip lever 53 occupies a horizontal position. It has a lost motion connection to the cam shaft 50. On pivotal movement of the cam shaft 50, FIG. 1 in a clockwise direction by the trip lever 53, the flared end 52 of the safety arm 51 is moved out of the path of the radially extending flange 31 while the cam arm 49 engages the lever arm 48 to pivot the trip bar means 40. Through the jaws 44 and 45 the radially extending flange 31 is moved laterally of the pinion 21 and out of mechanical engagement with the pressure nut 32. While the pawl 36 continues to prevent reverse rotation of the ratchet wheel 35, the pinion 21, gear wheel 20 and drum 18 rotate freely and the chain 17 is permitted to unwind rapidly from the chain winding drum 18 to effect release immediately of the brakes fully and completely.

Since the chain 17 is under substantial tension when it is wound on the chain winding drum 18, its quick release and clockwise rotation is accomplished by outward movement of the upper link of the chain 17 as illustrated by broken lines in FIG. 1. These links are indicated at 56, 57 and 58 and temporarily occupy the positions indicated as a result of the force imparted thereto by rapid circular clockwise movement of the drum and its chain mounting pin 53 beyond bottom center.

In order to absorb a substantial portion of the shock incident to the energy imparted into the links 56, 57 and 58 energy absorbing chain stop means, shown generally at 59, is provided. It comprises an L-shaped metallic bracket, shown generally at 60, having its long leg 61 welded or otherwise suitably fastened at 62 to the side wall 15 and its short leg 63 welded at 64 to the side wall 15. Secured by bolts 65 or otherwise fastened, only one being shown, to the underside of the short leg 63 are blocks of compressible, impact-resistant, resilient rubber-like solid material 66 such as polyurethane. While two blocks 66 of resilient solid material are shown, a single block or more than two blocks can be used as desired.

As illustrated in FIG. 1, the link 57 impacts against the underside of the lower blocks 66 when the chain 17 is unwound. Thereupon a substantial portion of the energy imparted to the links 56, 57 and 58 is absorbed with little attendant noise or permanent deformation of the contacting parts or damage to the brake mechanism.

Figures 3, 4, 5:
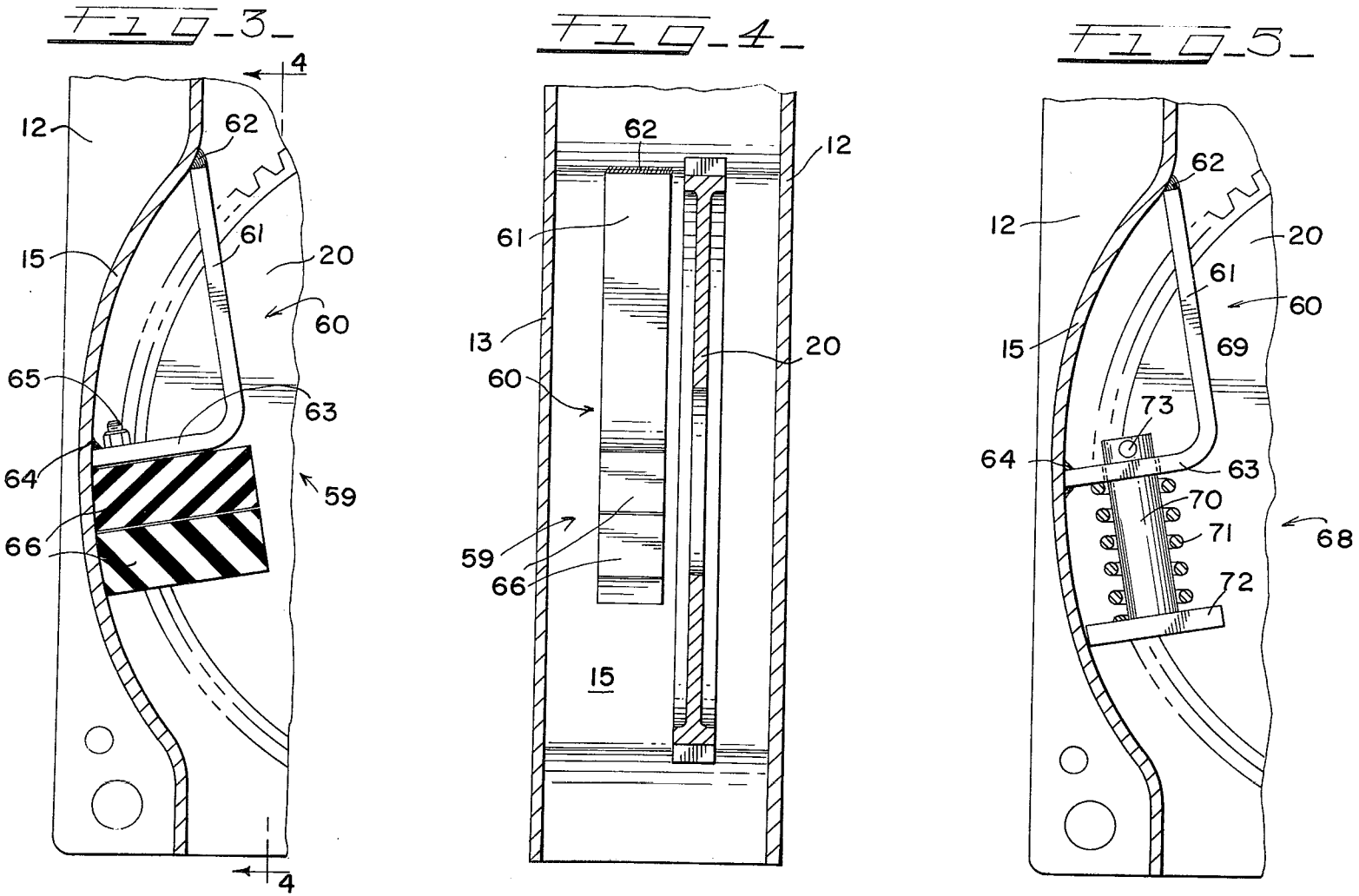
FIG. 3 is an elevational view, at an enlarged scale and partly in section, of the embodiment of the energy or shock absorbing means shown in FIG. 1.
FIG. 4 is a partly in section and partly in elevation view taken generally along line 4—4 of FIG. 3.
FIG. 5 is a view, similar to FIG. 3, showing another embodiment of this invention.

FIG. 5 shows, generally at 68 alternate energy absorbing chain stop means. It employs the L-shaped bracket 60, previously described, and secured to the inside of the side wall 15. The short arm 63 of the bracket 60 is provided with a clearance opening 69 for translatorily mounting a stud 70 that is surrounded by a coil compression spring 71 which reacts between the underside of the short arm 63 and a striker plate 72 at the distal end of the stud 70. A cross pin 73 above the short arm 63 limits the downward movement of the stud 70. A substantial portion of the kinetic energy incident to the quick release of the chain 17 is absorbed by the spring 71 when the link 57 engages the underside of the plate 72.

Other energy or shock absorbing means than the blocks 66 and coil spring 71 can be employed. There include elastomer springs, Belleville washer groups and the like.

I claim:

1. In a hand brake mechanism, the combination with a housing, a chain winding drum and a main gear wheel rotatably mounted on said housing, a hand wheel shaft rotatably bearingly mounted on said housing substantially centrally and at one end of said shaft and having a hand wheel receiving section at the other end externally of said housing, a ratchet wheel intermediate the ends of said shaft and rotatable therewith, a pawl in said housing cooperating with said ratchet wheel to hold it against reverse rotation, a pinion freely rotatable on said shaft and engaging said main gear wheel and having a radially extending flange rotatable conjointly therewith, a disengageable driving connection between said flange and said ratchet wheel, a trip cam rotatably mounted in said housing, trip bar means operable by said trip cam for co-operating with said flange for moving it to disengage said driving connection and permit said pinion to rotate freely to release said main gear wheel for rotation in a brake releasing direction accompanied by release of said chain winding drum and a chain wound thereon likely to be swung against an overlying side wall of said housing and to wind in the wrong direction on said drum of: energy absorbing means for stopping rotation of said drum and chain connected thereto comprising a bracket stationarily mounted in said housing, and resilient means carried by said bracket and located in the path of at least a portion of said chain or drum for absorbing some of its kinetic energy incident to release thereof under tension.

2. The energy absorbing means according to claim 1 wherein said bracket is secured to a side wall of said housing.

3. The energy absorbing means according to claim 1 wherein said bracket is secured to said housing.

4. The energy absorbing means according to claim 3 wherein said resilient means is mounted underneath said bracket.

5. The energy absorbing means according to claim 4 wherein said resilient means includes one or more blocks of compressible solid material.

6. The energy absorbing means according to claim 4 wherein said resilient means includes a compressible spring carried by a stud slidable through said short arm.

7. In a railway car hand brake mechanism having a housing adapted to be uprightly mounted, a chain winding drum rotatably supported on a shaft journaled within said housing, a hand wheel mounted on an exteriorally projecting portion of a hand wheel shaft journaled within said housing, driving means releasably interconnecting said drum in driven relationship with said hand wheel, trip means operatively interconnected with said driving means for tripping said brake, a chain anchored at one end to said drum and extending through the bottom of said housing with its opposite end connected to the brake rigging and a rigid chain stop mounted within said housing so as to be impacted by said chain when said brake is tripped, the improvement comprising, compressible energy-absorbing means including at least one block of a solid resilient rubber-like material mounted on said chain stop so as to be impacted by the links of said chain.

8. The improvement of claim 7 wherein said material is formed of polyurethane.

9. In a railway car hand brake mechanism having a housing adapted to be uprightly mounted, a chain winding drum rotatably supported on a shaft journaled within said housing, a hand wheel mounted on a exteriorally projecting portion of a hand wheel shaft journaled within said housing, driving means releasably interconnecting said drum in driven relationship with said hand wheel, trip means operatively interconnected with said driving means for tripping said brake, a chain anchored at one end of said drum and extending through the bottom of said housing with its opposite end connected to the brake rigging and a rigid chain stop mounted within said housing so as to be impacted by said chain when said brake is tripped, the improvement comprising, compressible energy-absorbing means including a striker plate normally held in an extended position by at least one coil spring mounted on said chain stop so as to be impacted by the links of said chain.

* * * * *

UNITED STATES PATENT AND TRADEMARK OFFICE

CERTIFICATE OF CORRECTION

PATENT NO. : 3,933, 225

DATED : January 20, 1976

INVENTOR(S) : Frank E. Bretz, Jr.

It is certified that error appears in the above-identified patent and that said Letters Patent are hereby corrected as shown below:

Col. 1, line 22, change "stroke" to --strike--;

Col. 3, line 66, change "there" to --these--;
Col. 5, line 6, change "of" to --to--.

Signed and Sealed this

Twenty-eighth Day of September 1976

[SEAL]

*Attest:*

RUTH C. MASON
*Attesting Officer*

C. MARSHALL DANN
*Commissioner of Patents and Trademarks*